United States Patent [19]

Leber

[11] 4,309,173

[45] Jan. 5, 1982

[54] OARLOCK FOR INFLATABLE BOAT

[75] Inventor: Edmond Leber, Buhl, France

[73] Assignee: Sevylor, Paris, France

[21] Appl. No.: 42,575

[22] Filed: May 25, 1979

Related U.S. Application Data

[63] Continuation of Ser. No. 835,190, Sep. 21, 1977, abandoned.

[30] Foreign Application Priority Data

Sep. 23, 1976 [DE] Fed. Rep. of Germany ... 7629668[U]

[51] Int. Cl.[3] ..... B63H 16/06

[52] U.S. Cl. ..... 440/109; 440/106; 9/2 A

[58] Field of Search ..... 9/2 A, 11 A; 115/24.5, 115/24.6; 52/296, 298; D33/148 E; 440/106–109

[56] References Cited

U.S. PATENT DOCUMENTS

| | | | |
|---|---|---|---|
| D. 138,591 | 3/1947 | Curry | D33/148 E |
| 277,662 | 5/1883 | Beach | 115/24.5 |
| 1,001,475 | 8/1911 | Starin | 115/24.5 |
| 2,517,332 | 7/1963 | Mitchell | 52/298 |
| 3,518,958 | 7/1970 | McCarthy | 115/24.5 |
| 3,659,298 | 5/1972 | Edwards | 9/2 A |
| 4,079,559 | 6/1976 | Kenbrum | 52/296 |

FOREIGN PATENT DOCUMENTS

| | | | |
|---|---|---|---|
| 939919 | 11/1948 | France | 115/24.5 |

*Primary Examiner*—Trygve M. Blix
*Assistant Examiner*—D. W. Keen
*Attorney, Agent, or Firm*—Robert E. Burns; Emmanuel J. Lobato; Bruce L. Adams

[57] ABSTRACT

A rowlock fitting for inflatable boats made as a unitary whole having a sole with a peripheral flange for adherence to the boat. Two upstanding, rigid, reinforcing ribs centrally located on a same side of the sole and integral therewith and made of a same material reinforce the central portion of the rowlock fitting and preclude transfer of twisting forces to the boat by the oars when in use. The ribs intersect substantially normal to each other. A rigid socket for an oarlock is disposed at a region of intersection of the ribs and is encircled by this region. The rigid ribs extend radially from the socket.

3 Claims, 5 Drawing Figures

OARLOCK FOR INFLATABLE BOAT

This is a continuation of application Ser. No. 835,190, filed Sept. 21, 1977, now abandoned.

BACKGROUND OF THE INVENTION

The present invention refers to rowlocks for a pneumatic boat, in particular for a boat employed for bathing, which consist of a socket including a vertical bearing and a peripheral flange.

In the case of pneumatic boats the difficult technical problem is posed of transmitting perfectly to the hull of the boat the forces acting upon the rowlocks and of neutralizing the forces of deformation existing during rowing.

During rowing, large reactions act upon the rowlocks and must be dissipated into the hull. If at the time of the distribution of these reactions a particularly flexible deformation occurs in the vicinity of the rowlocks, deterioration of the hull may result at this point. Furthermore in the case of too great a formation of the hull in the vicinity of the rowlocks, rowing proper and keeping the boat going straight are rendered more difficult.

Hitherto attempts have been made to find a solution to this problem by constructing rowlocks in which the socket proper with a relatively thick wall and including a vertical bearing is connected to the flange of the rowlock, the flange being one the wall thickness of which reduces uniformly. Practice has, however, shown that in this construction of rowlock the problem could not be entirely satisfactorily solved.

SUMMARY OF THE INVENTION

The aim of the invention is to put forward a rowlock of stable shape, which transmits into the hull proper, widely and uniformly, the force of reaction, and which consequently reduces to a minimum the deformations caused during rowing.

For this purpose a rowlock is proposed which consists round the socket including the vertical bearing, of a shoe and a peripheral flange as well as a number of reinforcing ribs, and in which in accordance with the invention there are advantageously provided between the socket and the shoe four reinforcing ribs arranged in a cross, each including an aperture with its axis horizontal.

Of the four reinforcing ribs two form a pair of longitudinal ribs and two form a pair of transverse ribs; each pair of ribs has a common axis.

The rowlocks are fastened to the hull of the pneumatic boat proper so that the axis of the longitudinal ribs is parallel with the longitudinal axis of the boat, and the axis of the transverse ribs is parallel with the transverse axis of the boat.

In accordance with another characteristic of the invention two adjacent rowlocks located at one and the same side of the pneumatic boat are stayed together by at least one reinforcing bar or by a reinforcing tube. In this case the reinforcing bar or reinforcing tube respectively are introduced into the apertures in the transverse ribs and secured against axial displacement.

With this method of reciprocal staying of two rowlocks, one with respect to the other, deformation of a rowlock during rowing is particularly reduced in a very advantageous way and there results reinforcement in the longitudinal axis of the boat.

BRIEF DESCRIPTION OF THE DRAWINGS

In the drawing there is represented by way of example an embodiment which is the object of the invention.

DESCRIPTION OF THE PREFERRED EMBODIMENT

Figure 1:
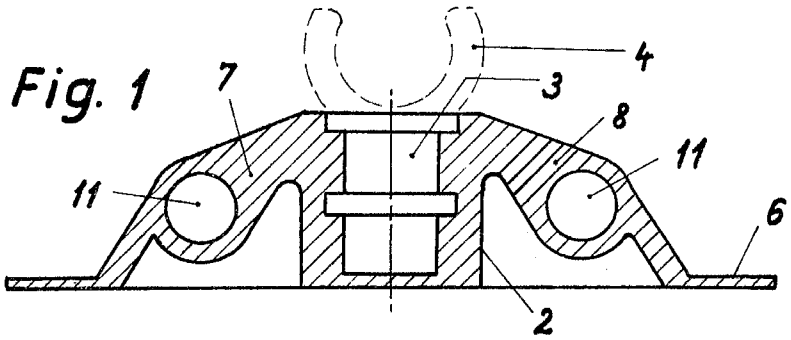
FIG. 1 represents a vertical longitudinal section (="coupe") through a rowlock along the axis as FIG. 2.
Figure 2:
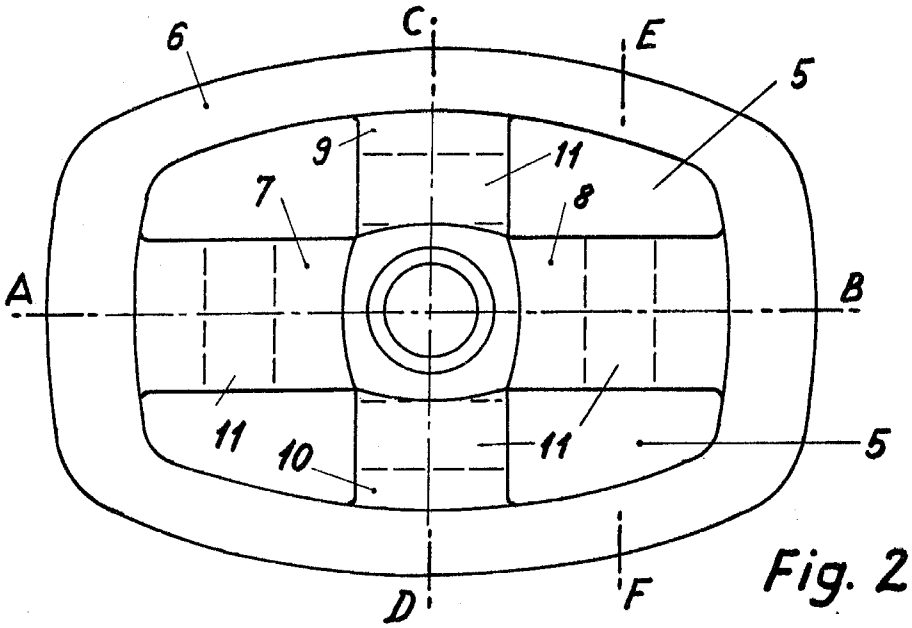
FIG. 2 shows a plan of the unit.
Figure 3:
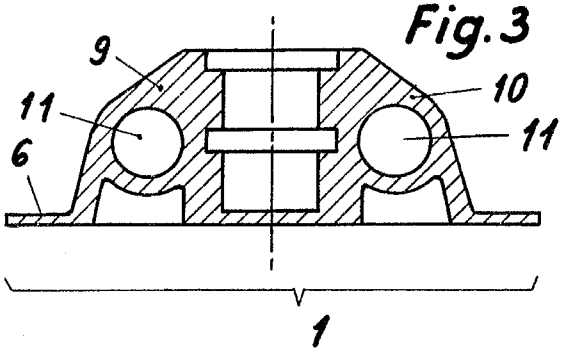
FIG. 3 shows a vertical transverse section along the axis CD as FIG. 2.
Figure 4:
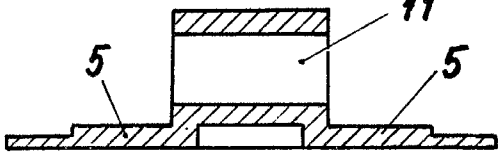
FIG. 4 shows a partial vertical section along the axis EF as FIG. 2.

As shown in FIGS. 1,2,3 and 4 a socket 2 which comprises a vertical bearing 3 is arranged at the centre of a rowlock 1. A swivel rowlock 4 is mounted rotatably in the vertical bearing 3.

The bottom portion of the rowlock 1 consists of a sole 5 which is extended by a peripheral flange 6. The latter serves for the connection with the hull of the pneumatic boat proper, this connection being ensured by gluing, vulcanization or welding.

Between the socket 2 and the sole 5 are arranged 4 reinforcing ribs 7,8,9,10. The ribs 7 and 8 form a pair of longitudinal ribs; the ribs 9 and 10 form a pair of transverse ribs. Each pair of ribs has a common axis. In each reinforcing rib 7,8,9,10 is arranged an aperture 11 with its axis horizontal.

As a lifeline for swimmers during bathing and likewise for carrying the pneumatic boat when inflated, the boat is equipped in a suitable way with a peripheral rope which is fastened to the rowlocks 1 and which preferably is passed through the apertures in the reinforcing ribs.

Figure 5:
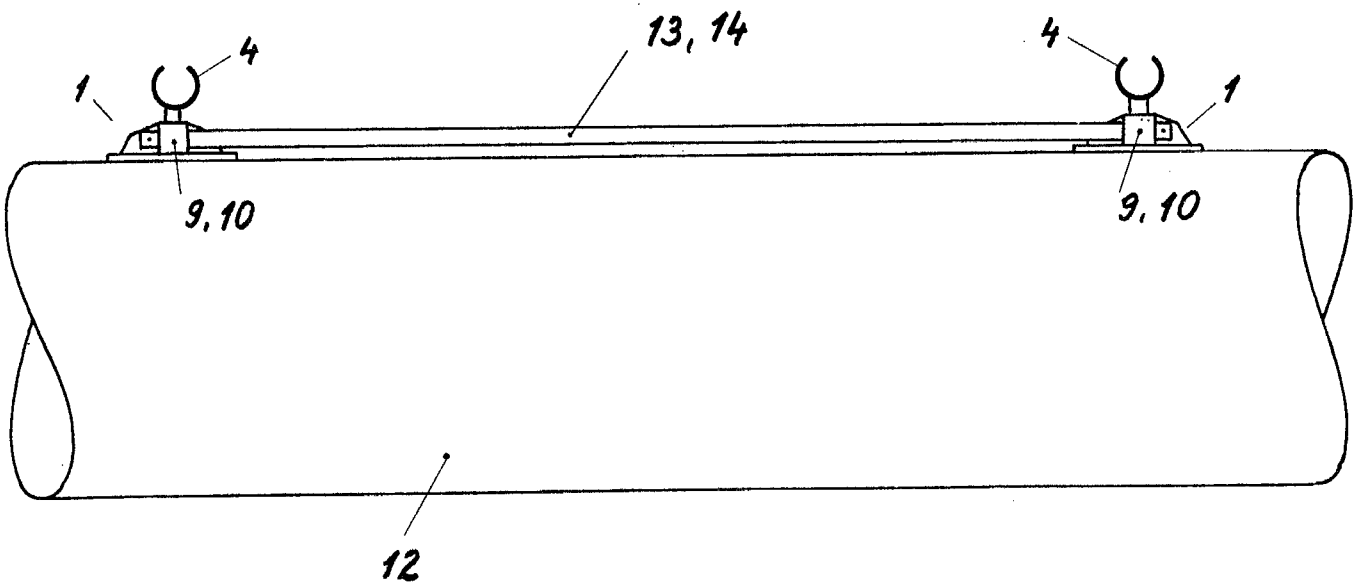
FIG. 5 shows a vertical section through one wall of a pneumatic boat equipped with two rowlock units and a reinforcing bar or reinforcing tube respectively.

FIG. 5 is a part view of one side of the pneumatic body in the form of a cylinder 12 (longitudinal wall), onto which are fastened two adjacent rowlocks 1 with their swivel rowlocks 4. These two adjacent rowlocks stay each other mutually by means of of a reinforcing bar 13 or a reinforcing tube 14 respectively; the reinforcing bar 13 or reinforcing tube 14 respectively pass through the apertures 11 in the transverse rib 9 or the transverse rib 10 respectively. One may equally well employ for two adjacent rowlocks 1, two reinforcing bars 13 or two reinforcing tubes 14 respectively.

The rowlock which is the object of the invention may be employed especially on any pneumatic boat.

I claim:

1. A rowlock fitting for inflatable boats comprising, a sole adhereable on an inflatable boat having an integral, flexible peripheral flange, two rigid, upstanding, reinforcing ribs centrally located on a same side of said sole integral therewith and of same material as said sole and said flange, said flange extending peripherally of said ribs said ribs intersecting substantially normal to each other and defining an enlarged area of integral juncture having a central recess, a rigid socket in said recess for an oarlock at said area of juncture constituting a region of intersection of the two ribs, said region of intersection peripherally and axially completely enclosing said rigid socket, and said rigid ribs extending radially from said socket, each of said ribs having a hole transverse thereof, and said flange and said ribs are integral and made of a thermoplastic material.

2. A rowlock fitting for inflatable boats comprising, a sole adhereable on an inflatable boat having an integral, flexible peripheral flange, two rigid, upstanding, reinforcing ribs centrally located on a same side of said sole integral therewith and of same material as said sole and said flange, said flange extending peripherally of said ribs said ribs intersecting substantially normal to each other and defining an enlarged area of integral juncture having a central recess, a rigid socket in said recess for an oarlock at said area of juncture constituting a region of intersection of the two ribs, said region of intersection peripherally and axially completely enclosing said rigid socket, and said rigid ribs extending radially from said socket, said sole having a length greater than a width thereof and in which said rigid ribs have axes in the direction of the length and width respectively, one rib extending in the direction of the width having a greater width than another of said ribs extending in the direction of the length, each of said ribs having holes transverse thereof for receiving a line therethrough.

3. A rowlock according to claim 2, in which said flange and said ribs are integral and made of a thermoplastic material.

* * * * *